United States Patent [19]

Shay, III et al.

[11] Patent Number: 5,041,717

[45] Date of Patent: Aug. 20, 1991

[54] UNIVERSAL SKI BOOT HEATER

[75] Inventors: Robert J. Shay, III, Park City, Utah; Stephen E. Rice, Del Mar, both of Calif.

[73] Assignee: Alpine International Corporation, Park City, Utah

[21] Appl. No.: 418,840

[22] Filed: Oct. 10, 1989

[51] Int. Cl.[5] ..... A43B 7/04

[52] U.S. Cl. ..... 219/211; 36/2.6

[58] Field of Search ..... 219/211, 528, 529, 549, 219/523; 36/2.6, 117

[56] References Cited

U.S. PATENT DOCUMENTS

| | | | |
|---|---|---|---|
| 1,275,451 | 8/1918 | Lillard | 219/211 |
| 2,025,950 | 12/1935 | Kurtz | 219/211 |
| 2,692,326 | 10/1954 | Crowell | 219/211 |
| 3,663,796 | 5/1972 | Hines | 219/211 |
| 3,859,496 | 1/1975 | Giese | 219/211 |
| 3,946,193 | 3/1976 | Giese | 219/211 |
| 3,977,093 | 8/1976 | Santroch | 36/2.6 |
| 4,080,971 | 3/1978 | Leeper | 128/382 |
| 4,279,255 | 7/1981 | Hoffman | 128/402 |
| 4,507,877 | 4/1985 | Vaccari et al. | 36/2.6 |
| 4,697,359 | 10/1987 | Balbinot | 36/2.6 |
| 4,780,968 | 11/1988 | Bragagnolo | 36/2.6 |
| 4,798,933 | 1/1989 | Annovi | 219/211 |
| 4,862,603 | 9/1989 | Balbinot | 36/2.6 |
| 4,894,931 | 1/1990 | Senee et al. | 36/2.6 |
| 4,910,881 | 3/1990 | Baggio et al. | 36/2.6 |
| 4,937,494 | 6/1989 | Maier | 322/1 |
| 4,948,951 | 8/1990 | Balzano | 219/528 |
| 4,950,858 | 8/1990 | Slenker | 219/211 |

FOREIGN PATENT DOCUMENTS

| | | | |
|---|---|---|---|
| 146353 | 9/1902 | Fed. Rep. of Germany | 219/211 |
| 8148 | 4/1908 | United Kingdom | 219/211 |

*Primary Examiner*—Teresa J. Walberg

*Attorney, Agent, or Firm*—Trask, Britt & Rossa

[57] ABSTRACT

A universal ski boot heating system, includes a boot assembly and a power pack assembly. The boot assembly employs a heating element disposable in a ski boot and electrically connected to a boot anchor secured to the exterior of the boot. The power pack assembly includes an elecrical energy source and means for engaging the boot anchor to permit selective contact between the energy source and the heating element through rotation of the power pack assembly when engaged with the boot anchor.

27 Claims, 7 Drawing Sheets

UNIVERSAL SKI BOOT HEATER

BACKGROUND OF THE INVENTION

The present invention relates generally to electrical heating systems for footwear, and specifically to a universal heating system adaptable to ski boots of any design and manufacture.

Cold, and specifically cold feet, has been a major limiting factor in the ability of the outdoor sportsman to appreciate and enjoy winter sports. As technology has improved throughout the years, fleece-lined leather boots have given way to footwear constructed using various synthetic shell materials and foam, Thinsulate TM and other insulations. This improved winter footwear has benefited skiers, who now enjoy a variety of rigid boot shell designs insulated with the aforementioned materials. However, since downhill or alpine skiers spend extended periods of time outdoors, two major problems still inhibit foot warmth, one being a function of the nature of the sport and the second of advances in boot technology. The first phenomenon referred to above involves the long periods of relative inactivity while skiing, attributable to lift lines and long lift rides, the latter on chair lift chairs which inhibit blood circulation to the lower extremities. The second phenomenon is associated with boot technology advances in the areas of foot retention and responsiveness of the boot and attached ski to body movement. Even though many different lasts are available for ski boot inner shells, and custom lasts are relatively inexpensive for the benefit gained, many skiers tighten their boots to an extraordinary degree to give better ski control and feedback from the ski through the foot, ankle and calf regions of the leg. This tightness constricts the foot and ankle regions, restricting blood flow thereto and contributing to cold feet.

Ski racers, like other skiers, experience the abovementioned problems. However, the adverse consequences of cold feet to their performance is even more dramatic at high racing speeds where the "feel" of the skis and terrain is all-important to promote optimum times and avert catastrophic injury.

Since completely insulated ski boot structures would be massive and unwieldy, many efforts have been made to artificially provide heat, generally electrical, to the feet. For example, U.S. Pat. No. 4,080,971 discloses a calf-mounted battery pack having a wire extending to a footwear insole incorporating a resistance heating element. This device is obviously inappropriate for skiing, as the bumps and shocks encountered as well as calf flexing would cause the battery pack to slip down the leg in short order. U.S. Pat. No. 4,837,494 discloses a ski-mounted battery pack including a wheel-type generator for battery recharging, the battery pack providing power to a resistance element in a ski boot through a connecting cable. The battery pack and generator weigh down and unbalance the ski, and the presence of cable connectors is a safety hazard to proper binding operation and to a total boot from ski release.

Several designs have been proposed for incorporating batteries in the ski boot structure itself. U.S. Pat. Nos. 3,977,093 and 4,507,877 each disclose batteries housed in boot or shoe soles, powering resistance heater type insoles. These designs render it virtually impossible to remove and replace batteries during a day of skiing, and additionally require specialized footwear designs having battery cavities. Additionally, the on/off switch of the '093 patent is inside the boot and activated by the heel of the wearer, preventing its being turned off. The '877 switch is on the exterior of the boot, and thus susceptible to water incursion and icing problems, as well as impact damage from skier falls.

U.S. Pat. No. 4,798,933 discloses another design, one of the type commonly seen in commercially-available heated ski boots today. This design uses a molded cavity in a bulge on the back of the ski boots to accommodate batteries, but there is no access to remove same except from the inside of the boot after the inner bladder or soft shell is removed. Again, as with the designs previously mentioned, the on/off switch is on the exterior of the boot.

U.S. Pat. Nos. 4,697,359 and 4,780,968 disclose several variations of a ski boot design with integral heater, wherein a plug-in type battery pack is housed in cavities or apertures which can be located on the back, instep or top front of the boot. The '359 patent discloses a battery pack having only contacts for plugging into the boot, the switch for turning the current on or off being included in the boot structure. The '968 embodiment includes the switch in the battery pack. The disadvantage of the foregoing designs resides in the necessity of special boot shells to accommodate the battery packs, and of fragile switches susceptible to icing as the boots become wet and then freeze during wear.

A more versatile boot heater design is disclosed in U.S. Pat. Nos. 3,859,496 and 3,946,193, wherein a battery case is mounted on the heel or back of a ski boot having a metal mounting plate thereon, and the heater is turned on and off by moving the battery pack up and down on the mounting plate on rails between an on and an off position. While this design is usable on any ski boot to which a mounting plate has been affixed, the use of electrical contacts on the exterior of the battery pack can result in shorts from water on the mounting plate or battery pack, and the boot wearer has to ascertain whether the heater is on or off by experimentally sliding the packs up or down on the plates, waiting to see if his feet get warm, or having a companion switch to turn the device on or off or observe which position the pack is in on the plate. Moreover, the mounting plate is itself mounted on a bracket secured to the ski boot, leaving the wires to the contacts exposed to the weather as well as build up of water, snow and ice, which accelerates deterioration thereof. Finally, the heating element is electrically connected to the mounting plate contacts via screws accessible only from the boot interior, making easy removal of the insole or boot liner impossible.

In short, the boot heaters of the prior art suffer from either reliability problems, operational problems, or manufacturing complexities which render them all inadequate in solving the problem of cold feet in an economical, reliable manner.

SUMMARY OF THE INVENTION

In contrast to the prior art, the ski boot heating system of the present invention provides reliability and simplicity as well as economic design.

The ski boot heating system of the present invention comprises a boot assembly and a power pack assembly. The boot assembly includes a heating element in the form of a flexible circuit substrate having an electrical resistance circuit thereon which extends from the top front of the boot insole, around the tip and back down the insole bottom where it may terminate at wires exiting the side or bottom of the boot bladder or inner shell, or alternatively it may extend out through a slit in the heel of the boot bladder or inner shell to the upper heel of the boot shell. In either case, the heating element is electrically powered via disconnectable contact pin means extending from the inside of the boot through the back or heel of the ski boot into contact post means secured in a non-conductive boot anchor securely fastened to the exterior of the boot heel or back. The boot anchor includes a plurality of radially-extending lugs, tabs or protrusions. The power pack assembly includes a case containing an electrical power source in a compartment, preferably two rechargeable Ni-Cad sub "C" cells connected in series via a shunt and contacted by two battery spring contacts extending into a cavity at the base of the case, the cavity having an open aperture defined at its periphery by a series of slots or discontinuities adapted to receive the like-shaped lugs, tabs or protrusions on the boot anchor. An elastomeric sealing element may surround and extend downwardly from the periphery of the cavity opening, and compressively seal against a continuous lip or flange protruding laterally from the boot anchor below the lugs when the power pack assembly is placed over the boot anchor so that the boot anchor lugs or protrusions are aligned with the slots or discontinuities. Alternatively, a flexible donut may surround the aperture inside the cavity to exclude ice, snow and water.

To engage the boot anchor with the power pack, the power pack is rotated thereon after the lugs enter the case slots, a wave spring washer inside the case cavity being compressed by the intruding boot anchor so as to firmly hold the case in position. If the case is rotated 90° in either direction, the case is locked to the boot anchor, but the heating system remains inoperative as the spring contacts do not engage the contact posts protruding through the center of the boot anchor. Further 90° rotation in the same direction as the initial rotation results in the completion of the electrical circuit between the batteries in the power pack assembly and the heating element in the boot assembly.

BRIEF DESCRIPTION OF THE DRAWINGS

The present invention will be more readily understood by one of ordinary skill in the art through a review of the following detailed description of a preferred embodiment, taken in conjunction with the accompanying drawings, wherein:

FIG. 16 being a bottom interior elevation of a battery housing cover and FIG. 16A being a section thereof taken along line A—A; FIGS. 17, 17A–C and 18 being various views of a contact spring housing; FIG. 19 being a top elevation of a battery housing cover and FIG. 19A being a section thereof taken along line A—A; FIGS. 20–22 being views of a spring housing cap; and FIGS. 26 and 27 being end and side elevations of a spring contact.

DETAILED DESCRIPTION OF THE PREFERRED EMBODIMENTS

Figure 1:
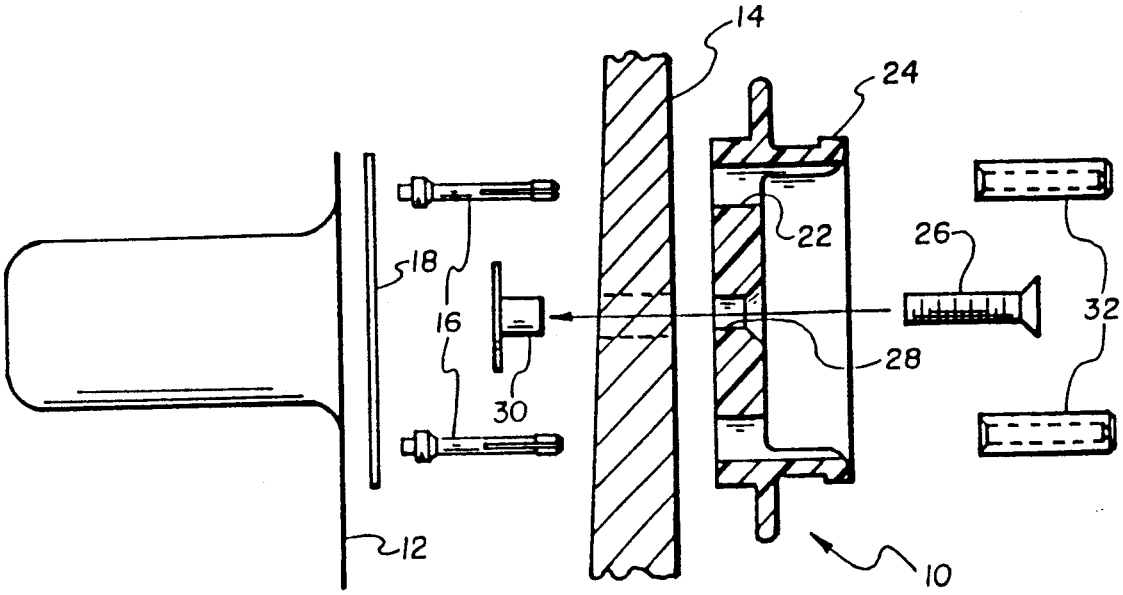
FIG. 1 is an exploded view of the components of the boot assembly of a first preferred embodiment of the present invention.
Figure 3:
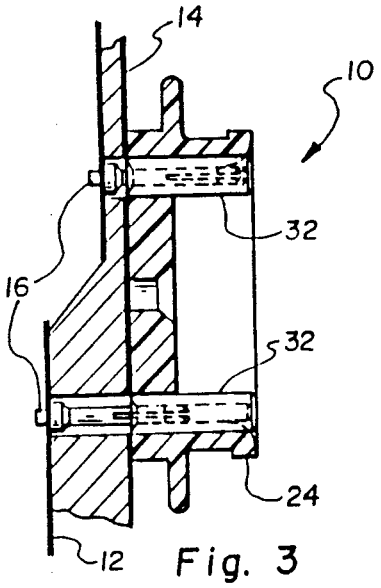
FIG. 3 is a side section of the boot anchor portion of the boot assembly installed on a ski boot.
Figure 13:
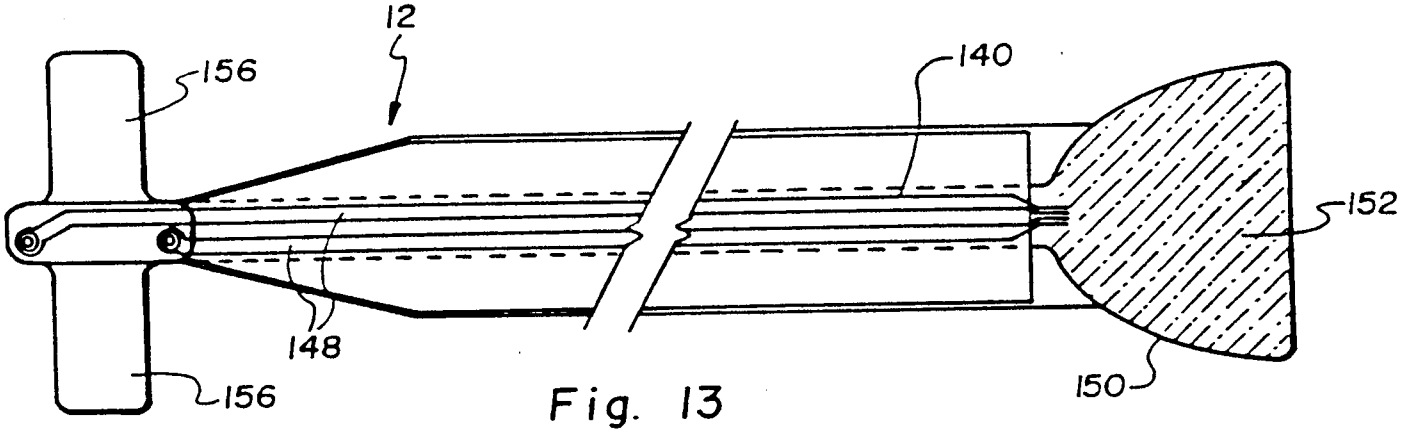
FIGS. 13, 14 and 14A depict a heating element used with the present invention, FIG. 14A being an enlarged section taken at A in FIG. 14.
Figure 14:
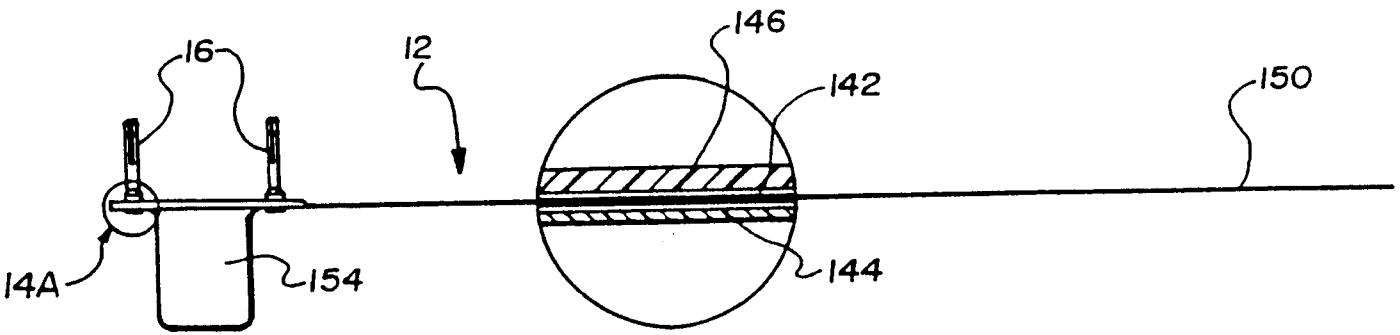
Figure 14A:
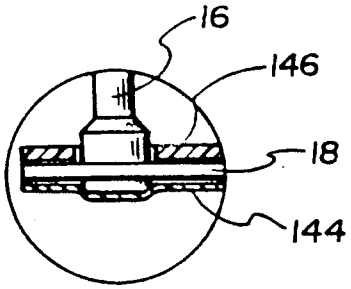

Referring now to FIGS. 1 and 3 of the drawings, a first preferred embodiment of the boot assembly 10 of the present invention will be described in detail. Boot assembly 10 includes a flexible printed electrical resistance circuit heating element 12 to provide heat to the foot of the boot wearer. The heating element 12 depicted in detail in FIGS. 13, 14 and 14A is electrically connected through the upper heel section 14 of a ski boot via two element contact pins 16 which extend through a semi-rigid phenolic support 18 into and through apertures 20 in heating element 12, where the ends thereof are upset to permanently secure the pins to the heating element. As can be seen in both FIGS. 1 and 3, pins 16 are slotted to provide resilience when laterally compressed, and extend through boot section 14 into contact apertures 22 in boot anchor 24, which is secured to boot section 14 by two screws 26 extending inwardly through anchor apertures 28 boot section 14 to engage "T" nuts 30. Contact pins 16 are laterally compressed by sleeve-like anchor contact posts 32 surrounding pins 16 where they extend through contact apertures 22, contact pins 16 being frictionally but removably secured in anchor contact posts 32 by the aforementioned lateral resiliency imparted by the diametrical slots. Anchor contact posts 32 may be adhesively bonded or mechanically secured by interference fit to boot anchor 24.

As can be seen in FIG. 3 of the drawings, the sliding frictional engagement of contact pins 16 in anchor contact posts 32 permits the boot assembly 10 of the present invention to be installed on any standard ski boot whether the boot wall is merely a thin plastic shell or is a heavy laminate. The frictional contact also permits the boot liner or bladder to which heating element 12 is affixed to be easily removed from the outer boot for drying after wear or for installation or removal of custom-fit prosthetic devices such as arch supports, heel lifts, etc.

Figure 2:
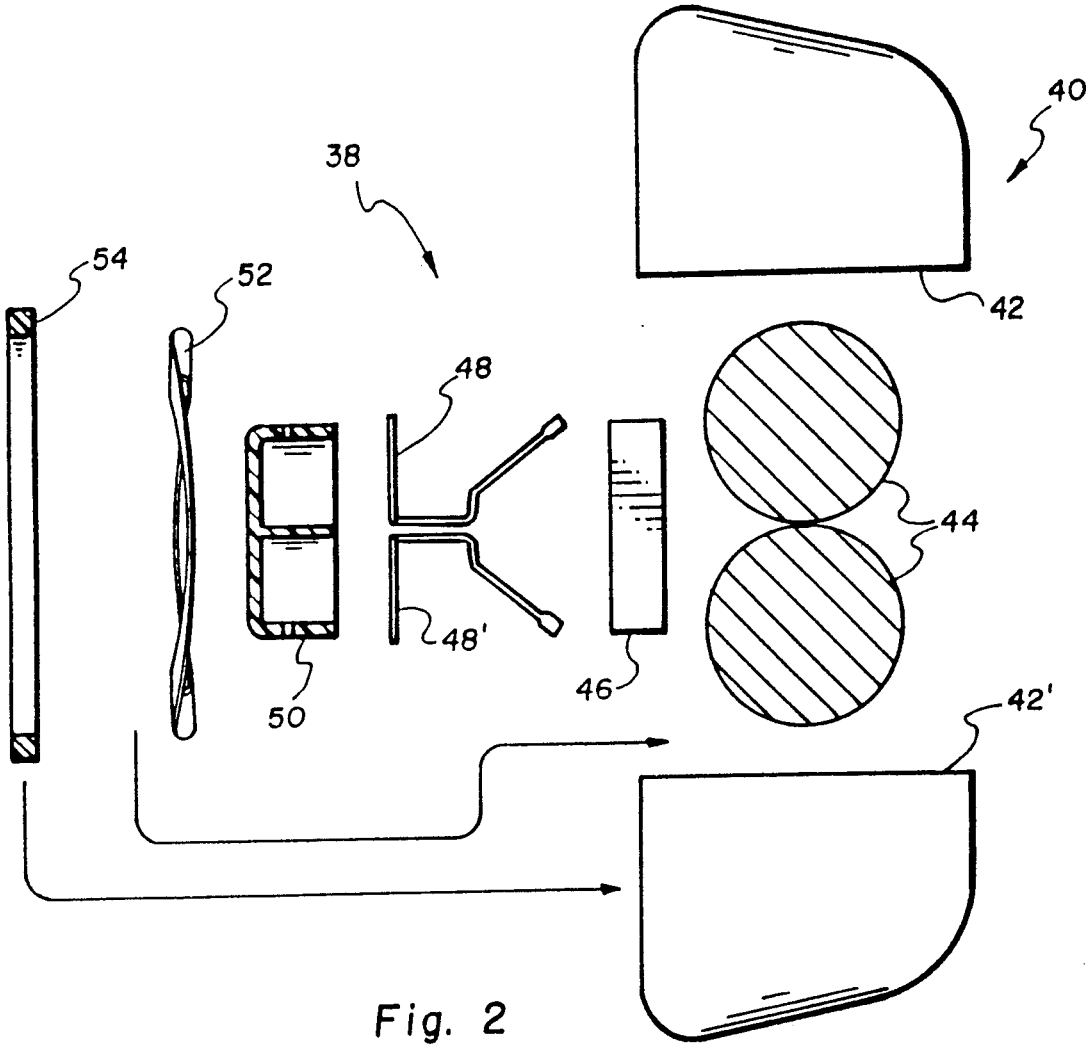
FIG. 2 is an exploded view of the components of the power pack assembly of a first preferred embodiment of the present invention.
Figure 4:
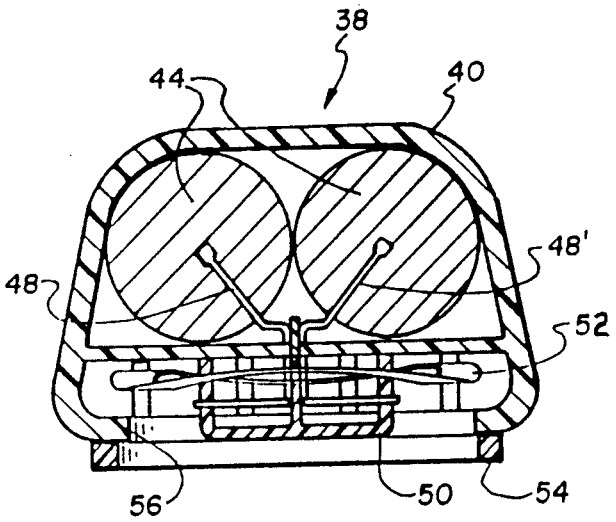
FIG. 4 is a side section of the power pack assembly of the present invention.

FIGS. 2 and 4 of the drawings show a first preferred embodiment of the power pack assembly 38 of the present invention. Assembly 38 comprises a battery case 40, including two mirror image battery case halves 42 and 42', which encase two sub "C" cell Ni-Cad rechargeable batteries 44. Batteries 44 are electrically connected in series by battery shunt 46, and electrical connection to anchor contact posts is provided by two mirror-image battery spring contacts 48 and 48', which are fixedly mounted in and to plastic contact housing 50, which in turn is secured to case 40. Wave spring washer 52 surrounds contact housing 50 inside of battery case 40. Elastomeric water seal 54 is bonded to the bottom of battery case 40 and surrounds the boot anchor receptacle aperture 56 extending into the interior of the battery case 40. The battery case halves and the contact housing may be adhesively or mechanically secured together into an assembly, as well known in the art.

Figure 5:
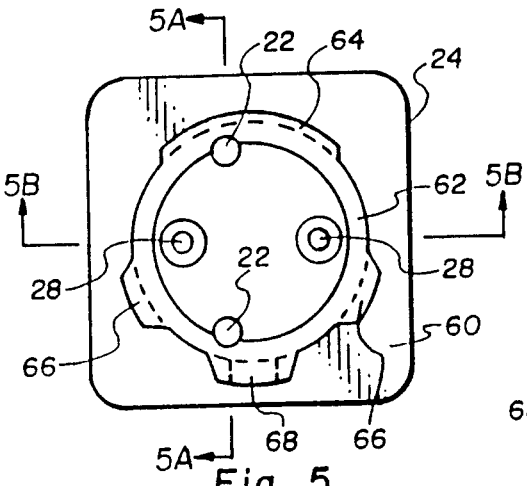
FIGS. 5, 5A, 5B and 6 depict the boot anchor used with the boot assembly of FIGS. 1 and 3, FIG. 5 being a top elevation of the boot anchor and FIGS. 5A and 5B being sections taken along lines A—A and B—B of FIG. 5.
Figure 5A:
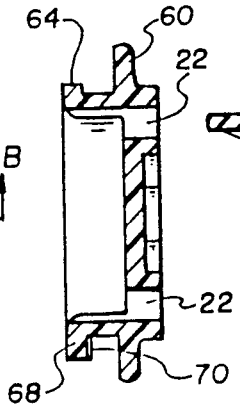
Figure 5B:
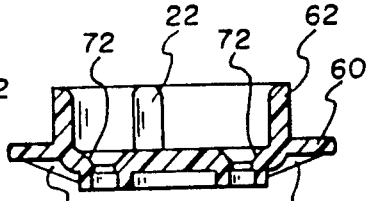
Figure 6:
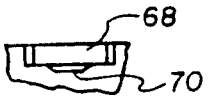
Figure 7:
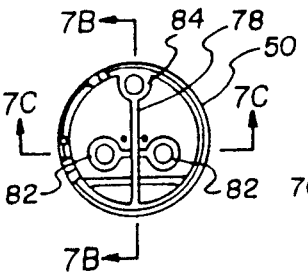
FIGS. 7, 7A, 7B, 7C and 7D depict the spring contact housing used with the power pack assembly of FIGS. 2 and 4, FIG. 7 being a bottom interior elevation of the housing, FIG. 7A being a side elevation thereof, FIGS. 7B and 7C being sections taken along lines B—B and C—C of FIG. 7, and FIG. 7D being an enlarged detail of the edge of the housing taken at D in FIG. 7A.
Figure 7A:
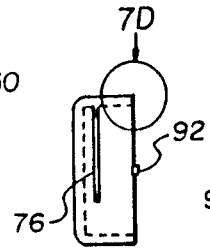
Figure 7B:
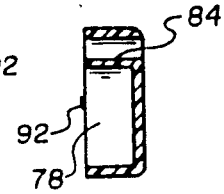
Figure 7C:
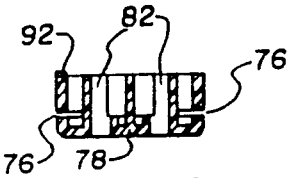
Figure 7D:
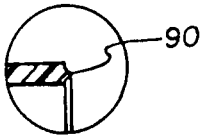

A more complete appreciation of the sophisticated simplicity and the advantages of the present invention over the prior art will be afforded through reference to the components of the invention. FIG. 5 shows boot anchor 24 from the top, as it would appear when mounted on a ski boot heel. Referring to FIGS. 5, 5A, 5B and 6, boot anchor 24 includes a laterally extending flange 60 of square configuration, surmounted by a truncated tubular anchor element 62 having lugs, tabs or flanges 64, 66 and 68 extending laterally therefrom at its top periphery. Lug 64 defines a larger arc than lugs 66 and 68, both of which extend farther from the periphery of element 62 than lug 64. Lug 68 is placed symmetrically diametrically opposite lug 64, and lugs 66 flank lug 68 symmetrically to either side. The lower surface of lug 68 (see FIG. 6) includes a detent 70 having tapering side surfaces. The interior of boot anchor 24 includes contact apertures 22 (to accommodate contact posts 32) which extend at their upper ends into the wall of element 62, and anchor apertures 28, which have at their outer ends chamfers 72 to accommodate the heads of screws 26 where anchor 24 is secured to a ski boot. Struts 74 under flange 60 support flange 60 against forces exerted when power pack assembly is being attached to boot anchor 24, and generally lend rigidity to boot anchor 24.

Referring to FIGS. 7 and 7A–7D, contact housing 50 comprises a cup-shaped plastic molding having symmetrically placed laterally cut slits 76 in the outer walls thereof, a diametrically extending full-height central wall 78, a short lateral wall 80, two tubular spring towers 82 symmetrically flanking central wall 78, and a tubular end tower 84 at the end of central wall 78. Spring towers (see FIG. 7C) are cut out at their inner peripheries. The top edge 88 of contact housing 50 includes a tongue 90 (see FIG. 7D) and an alignment post 92.

Figure 8A:
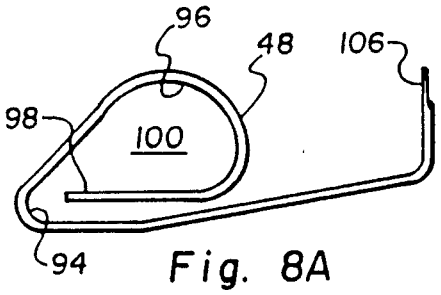
FIGS. 8A and 8B depict a spring contact used with the power pack assembly of FIGS. 2 and 4.
Figure 8B:
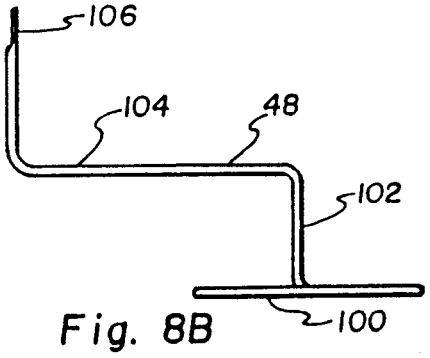
Figure 12:
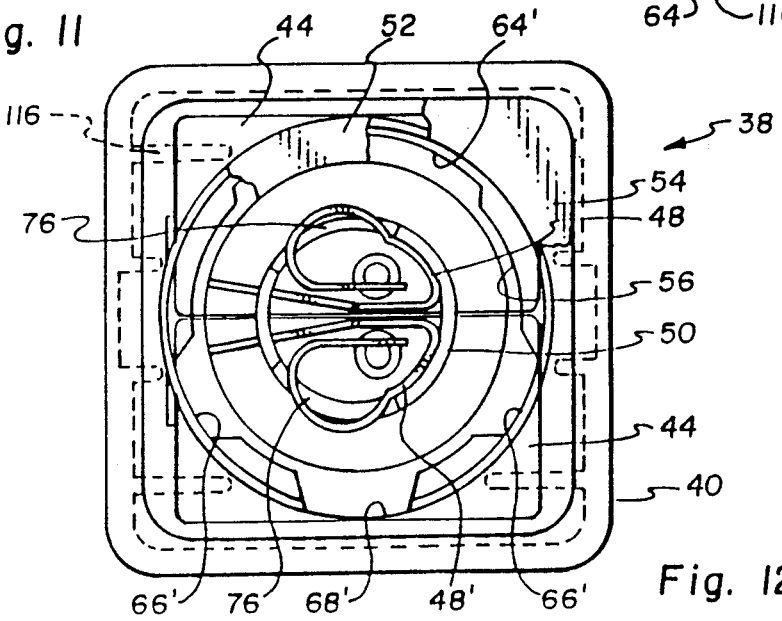
FIG. 12 is a composite bottom view of the elements of the power pack assembly of FIGS. 2 and 4

Spring contact 48 is depicted in FIGS. 8A and 8B, as well as being shown from a third perspective in FIGS. 2, 4 and 12. Spring contact 48, and its mirror-image twin, contact 48', are preferably of nickel-coated spring steel, such as music wire. Small arc 94 provides lateral resiliency to large arc 96 which extends through the slit 76 of contact housing 50 to provide selective electrical contact with posts 32. Inner leg 98 of contact 48 rests in a tower cutout in contact housing 50 and provides torsional stability to the large arc loop 100. Vertical leg 102, extending perpendicularly to the plane of large arc loop 100, extends through an aperture in the battery case to the battery cavity, and outer leg 104 leads to battery contact flat 106.

Figure 9:
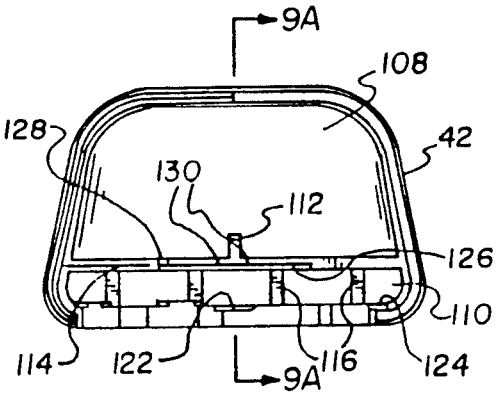
FIGS. 9, 9A, 10 and 11 depict one-half of the case of a power pack assembly of FIGS. 2 and 4, FIG. 9 being an interior side elevation, FIG. 9 being a side section taken along lines A—A of FIG. 9, FIG. 10 being a bottom elevation, and FIG. 11 being an exterior end elevation
Figure 10:
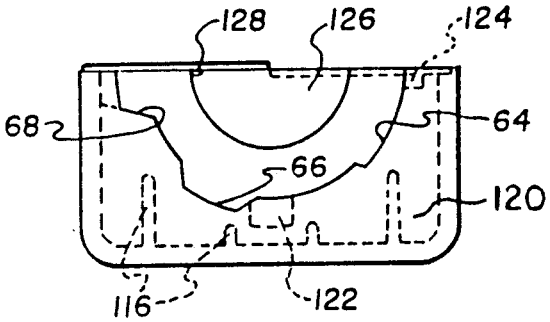
Figure 11:
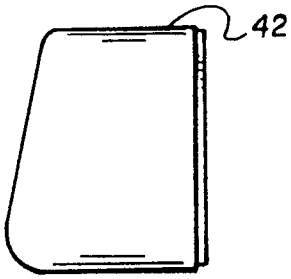
Figure 9A:
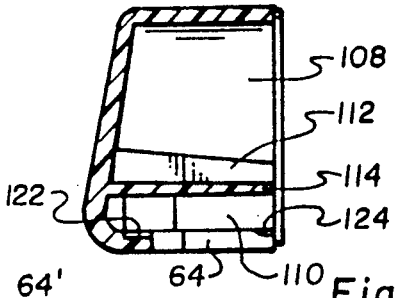

FIGS. 9–11 depict one-half 42 of battery case 40, it being understood and appreciated that mirror-image half 42' is of like, mating construction, the dividing line between the case halves symmetrically defining anchor receptacle aperture 56. Case half 42 is of high-impact plastic, and defines one-half of a battery cavity 108 and an anchor receptacle 110. Partition wall 112 extends from floor 114 in the center of battery cavity 108 and assists with case rigidity and proper alignment of spring contacts 48 and 48' (see FIG. 4). Spring alignment struts 116 center wave spring 52 in anchor receptacle 110 where case 40 is assembled (see FIG. 12). The bottom 120 of case half 42 defines one-half of anchor receptacle aperture 56, which includes slots 64', 66' and 68' of similar orientation and configuration to boot anchor lugs 64, 66 and 68. Due to the symmetry of case half 42, one-half of slots 64' and 68' are present in case half 42, the other half in case half 42'. One each of slots 66' is located in the bottom of each case half. Similarly, a locking recess 122 is located in case half 42 and another in case half 42', while each case half defines one-half of switching recess 124. Locking recesses 122 are diametrically opposed in assembled case 40, and switching recess is located perpendicularly to a diametrical line extending between locking recesses 122. Half-circular contact housing recess 126 is located centrally on the bottom of case floor 114, the other half being located in case 42', the two defining a circle and an alignment post aperture 128 (half of it shown in FIG. 10) so that contact housing 50, when inserted into case 40 with spring contacts 48 and 48', will be properly rotationally aligned when alignment post 92 mates with aperture 128. Spring contact aperture halves 130, to permit the spring contacts 48 and 48' to extend from below to above floor 114 into battery cavity 108 (see FIG. 4) are located adjacent to and on either side of partition wall 112.

FIG. 12 shows various elements of power pack assembly 38 superimposed to better illustrate the alignment and relative dimensions of the various parts of the assembly. It is not an actual section, nor is it intended to be taken as such.

FIGS. 13, 14 and 14A depict a preferred embodiment of the heating element 12 of the present invention. The flexible resistance circuit 140 of element 12 is printed on plastic substrate 142. Substrate 142 is sandwiched between single-sided adhesive tape 144 on the bottom, and a fabric 146 affixed with pressure sensitive adhesive on the top. Fabric 146 also extends over support 18 and around contact pins 16. Tape 144 extends over the upset ends of pins 16, which hold pins 16 to circuit 140 and to support 18. Each pin 16 is in electrical communication with a circuit path 148, which extends to a resistance circuit grid (not shown) at the opposite end of circuit 140. This half-oval shaped grid, the location of which is designated at 150, is coated with a pressure sensitive adhesive 152 on its top. It should be noted that tape 144 stops short of grid 150. Finger tab 154 (FIG. 13), which is used to insert and pull out pins 16 from anchor contact posts 32, is formed by the adherence of wings 156 of fabric 146 to each other after folding around the laminate of tape 144 and substrate 142. As shown schematically in FIG. 15, the heating element grid 150 is adhered by adhesive 152 to the top 158 of a ski boot insole 160. The rest of the flexible circuit 140 on substrate 142 extends over the toe of the insole 160, along the bottom 162 thereof, and exits boot inner shell or bladder 164 (also referred to as a "bootie") through slit 166, running along the level 168 of bladder 164 to the point at which pins 16 can be inserted into the contact posts 32 of ski boot 14 (not shown in FIG. 15). Spacing between the aforementioned elements in FIG. 15 has been greatly exaggerated for clarity in understanding specific locational relationships.

Figure 15:
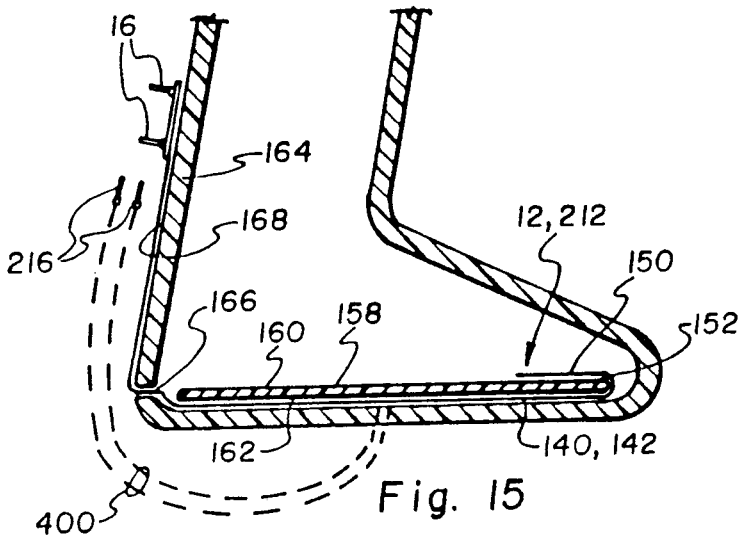
FIG. 15 is a schematic side section of a heating element disposed in a ski boot inner shell according to one preferred embodiment of the present invention.
Figure 16:
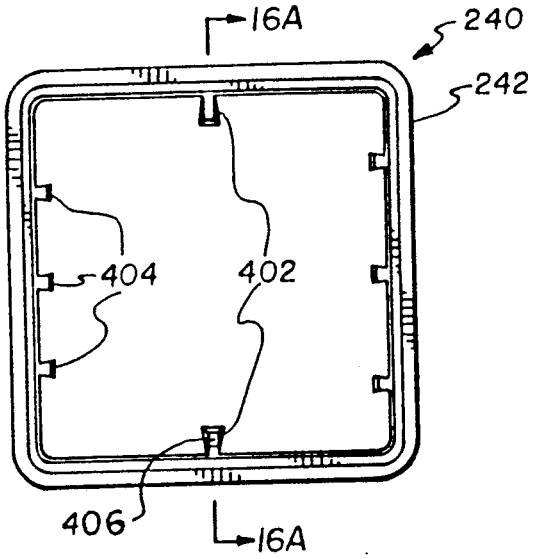
FIGS. 16 through 22, and 27 depict the components of a second preferred embodiment of the power pack assembly of the present invention.
Figure 16A:
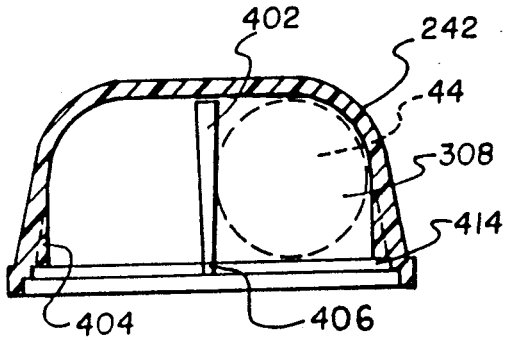
Figure 17:
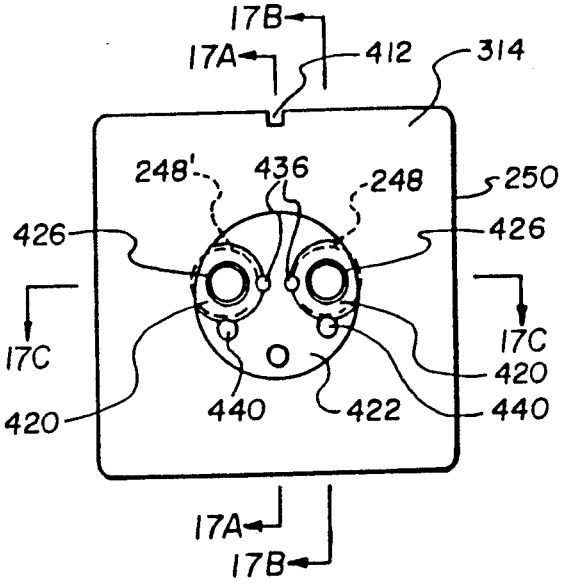
Figure 17A:
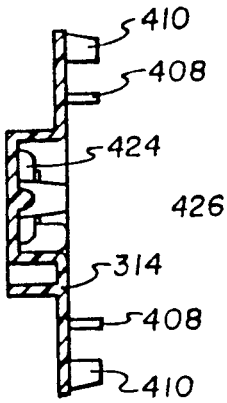
Figure 17B:
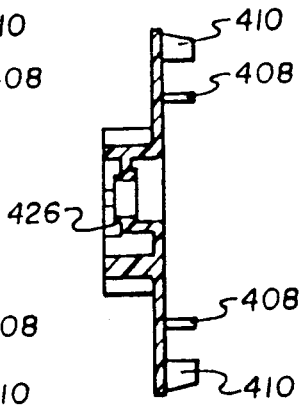
Figure 17C:
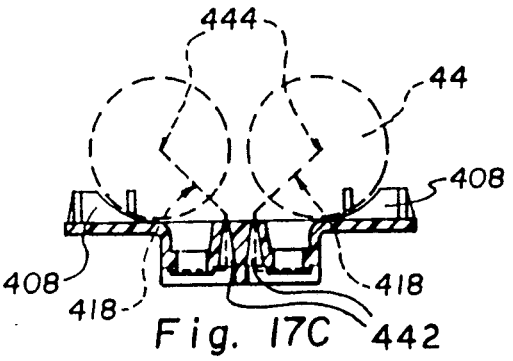
Figure 18:
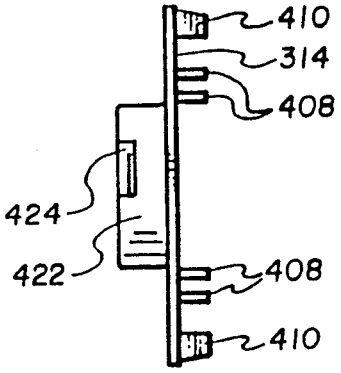

Referring now to all of the drawing figures, but particularly FIGS. 3, 4 and 12, the operation of the present invention will be described. Boot assembly 10 is installed, as previously discussed, on any pair of ski boots 14 of choice. Heating element 12 has been installed on the insoles 160 of the boots 14, and run inside of bladders 164 as shown in FIG. 15, bladders 164 then being installed in normal fashion in boots 14 and pins 16 inserted and frictionally held in anchor contact posts 32 of boot anchor 24. Power pack assembly 38 with fully charged batteries 44 is placed with aperture 56 facing boot anchor 24 at the heel of each boot 14. Slots 64', 66' and 68' on case 40 are aligned with lugs 64, 66 and 68 on boot anchor 24. Case 40 is placed over boot anchor element 62, which compresses wave spring 52 inside cavity 110. Case 40 is then turned 90° in either direction, which results in detent 70 on anchor lug 68 engaging one of two locking recesses 122 on the inside of case 40 and, with wave spring 52, locking power pack assembly 38 to boot anchor 24. The heater remains inactive at this point, because spring contacts 48 and 48' are not contacting anchor contact posts 32 on the inside of anchor 24. Further 90° rotation in the same direction as the initial rotation results in detent 70 engaging switching recess 124, and case 40 remains locked to anchor 24. The electrical circuit between batteries 44 and heating element 12 is now completed through contact pins 16, contact posts 32 and spring contacts 48 and 48', as the latter have been rotated into a position when they biasingly engage the sides of contact posts 42. Wave spring 52 provides sufficient resilience to lock case 40 to anchor 24 in either the locking or switching positions of power pack assembly 38, and water seal 54 compressively engages flange 60 on anchor 24 to form a watertight seal between flange 60 and the bottom of case 40, thus isolating the electrical connection and switching function between boot assembly 10 and power pack assembly 38 from water, ice and snow. When it is desired to turn off the heat, 90° rotation of case 40 will achieve that result, and further 90° rotation in the same direction can be used to remove power pack assembly just prior to a race, or to replace it with a fresh assembly, or to recharge batteries 44 at the end of the day.

Referring now to FIGS. 16–30 of the drawings, the elements of a second preferred embodiment of the invention will be described in detail. It should be understood that the elements of the second preferred embodiment differ primarily in structural simplicity, and that the heretofore-described method of operation of the first preferred embodiment is also applicable to the second.

The elements of an alternative preferred boot assembly 210 of the present invention are depicted in FIGS. 15, 23–25A and 28–30. Heating element 212 (see FIG. 15) is similar to heating element 12, except that the flexible circuit substrate terminates under the arch of the insole inside the bootie, bladder, or inner shell 164, whereupon the electrical circuit extends to the heel of the boot 14 via two twenty-two gauge wires 400, which extend through small apertures in the side or bottom of the bootie, bladder or inner shell 164 and run along the outside thereof. It has been found that the foregoing structure facilitates placement and retention of the heater element in the boot, as well as removal and reinsertion of the bootie, bladder or inner shell 164 with the heating element in place. Wires 400 may be soldered to contact pins 216 (FIG. 30) in addition to being mechanically clamped thereto by the upsetting of the ends thereof after extension through plenolic support 18, in the manner shown in FIG. 14A with respect to element 12 and pin 16.

However, it is actually preferred that pins 216 not be connected by support 18 in some instances, as certain brands of ski boots include ribbing on the interior of the boot shell and it is easier to extend the pins 216 between the ribs into posts 232 when pins 216 are not linked together or interconnected in a single assembly.

Pins 216 are not slotted or bifurcated as pins 16, and are frictionally maintained in anchor contact posts 232 (FIGS. 28, 29) by resilient inner fingers 233. The outer surface of posts 232 may be knurled as shown at 235, to facilitate an interference fit retention of posts 232 in contact apertures 222 of boot anchor 224, but this has been found to be unnecessary.

Boot anchor 224 (FIGS. 23–25A) is similar to boot anchor 24, and is secured to a ski boot 14 by two screws (not shown) similar to screws 26, but having a thread design adapted to engage the inner walls of anchor apertures 228 so that nuts, such as nuts 30, are unnecessary. Such screw designs are well known in the art and are not material to the present invention. Boot anchor 224 includes a truncated tubular anchor element 262 having lugs, tabs or flanges 264, 266 and 268 extending laterally therefrom at its top periphery, and the shape and placement thereof on anchor element 262 is virtually identical to the lug configuration of boot anchor 24, with the exception that there is no detent on the bottom of lug 268. Contact apertures 222, into which are inserted anchor contact posts 232, extend at their upper ends into the wall of element 262.

Referring to FIGS. 16–22, 26 and 27, an alternative preferred embodiment of power pack assembly 238 comprises a battery case 240, including a battery housing cover 242 and a battery housing base 244. Contact housing 250, a plastic molding like battery housing cover 242 and base 244, is sandwiched therebetween when case 240 is assembled, and provides a floor 314 for batteries placed inside battery cavity 308 of cover 242. Ni-Cad sub "C" cells 44 are deployed in battery cavity 308. Partition buttresses 402 and side buttresses 404 inside cover 242 provide rigidity to cover 242. Batteries 44 are supported by floor 314 of contact housing 250, and are positioned by cradles 408 (see FIG. 17C) and end stops 410. Alignment of contact housing 250 inside battery housing cover 242 is facilitated by the mating of alignment post 406 in alignment slot 412, contact housing 250 then being disposed in recess 414 against side buttresses 404 and buttresses 402. Spring contacts 248 and 248' are, like their counterparts 48 and 48', mirror images of one another, but are much simpler, comprising (FIGS. 26 and 27) contact loops 416 and leg 418. As shown in FIGS. 17, 17B, 17C and 18, contact loops 418 lie in arcuate channels 420 in contact housing tower 422 of contact housing 250, extending laterally beyond the diameter of tower 422 through windows 424. Channels 420 surround contact housing posts 426 and, when spring contacts 248 and 248' are disposed in channels 420, plastic caps 430 and 430' (FIGS. 20–22) are snapped over truncated posts 426 to maintain spring contacts 248 and 248' in place. Caps 430 and 430' are mirror images of one another, each having an edge 432 of enlarged radius to match that of tower 422, a tab 434 to align with dimples 436 off of channels 420 in towers 422, and a cutout 438 to align with ejector pin apertures 440 in tower 422.

Legs 418 of spring contacts 248 and 248' extend through frustoconical contact passages 442 when contact loops 416 are in channels 420, and are bent to reach the ends of Ni-Cad cells 44 (FIG. 17C), where they are soldered at 444 to the contacts thereof. As with the first preferred embodiment of the invention, the other ends of cells 44 are laterally electrically connected via a shunt 46 (not shown).

Figure 19:
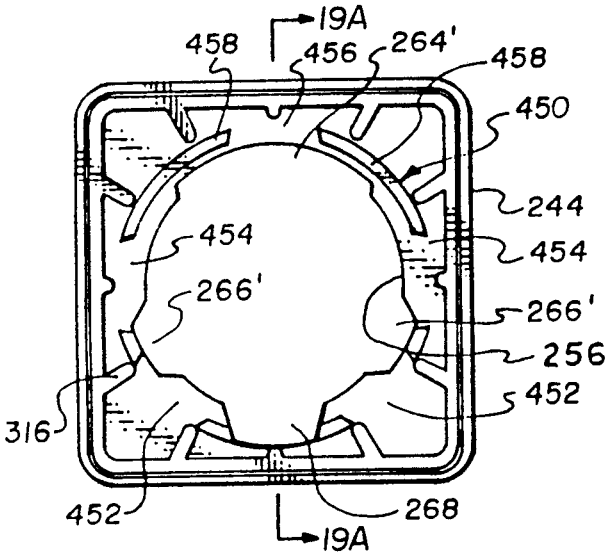
Figure 19A:
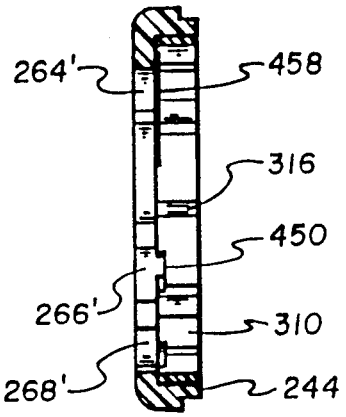
Figure 20:
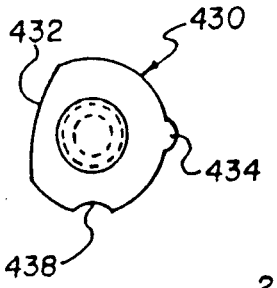
Figure 21:
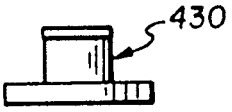
Figure 22:
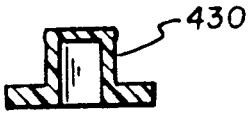
Figure 23:
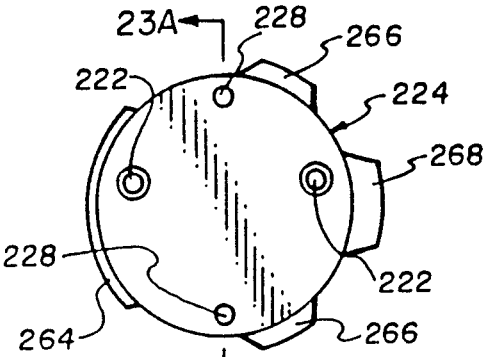
FIGS. 23, 23A, 24, 25 and 25A are views of a boot anchor according to a second preferred embodiment of the present invention, FIG. 23 being a bottom elevation, FIG. 23A being a side section taken along line A—A of FIG. 23, FIG. 24 being a side elevation, FIG. 25 being a top elevation, and FIG. 25A being a section taken along line A—A of FIG. 25.
Figure 23A:
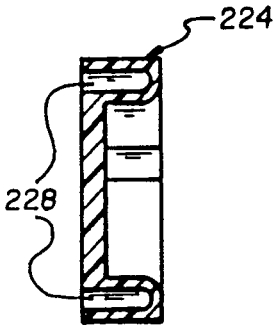
Figure 24:
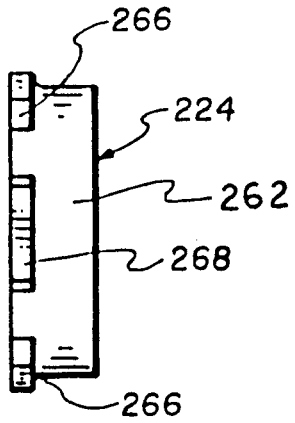
Figure 25:
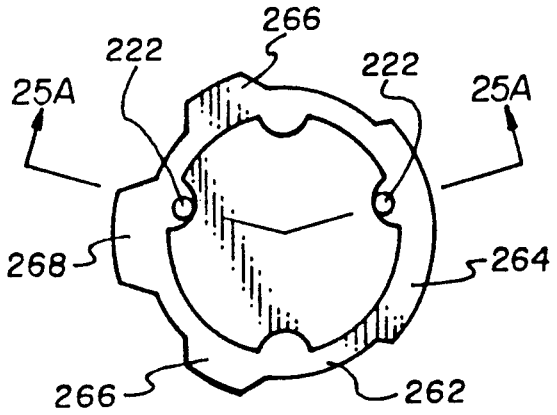
Figure 26:
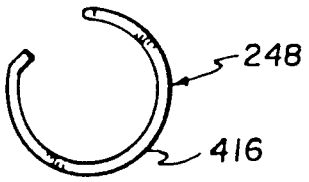
Figure 25A:
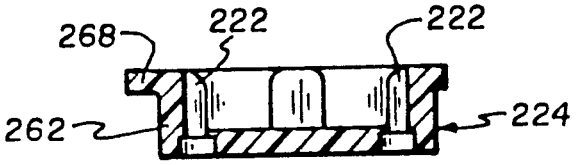
Figure 27:
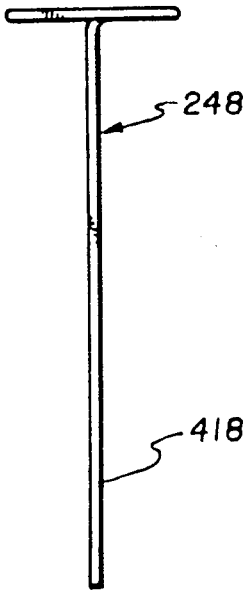
Figure 28:
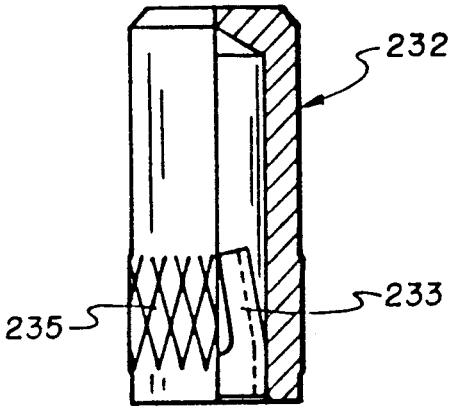
FIGS. 28 and 29 are, respectively, a side partial sectional elevation of a second preferred embodiment of an anchor contact post and a bottom elevation thereof.
Figure 30:
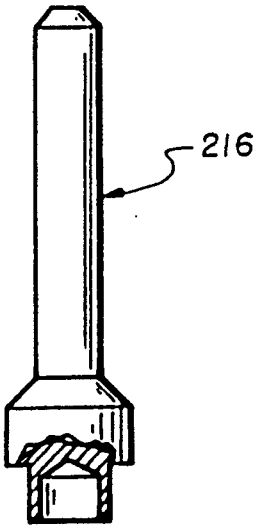
FIG. 30 is a side partial sectional elevation of a second preferred embodiment of a contact pin.
Figure 29:
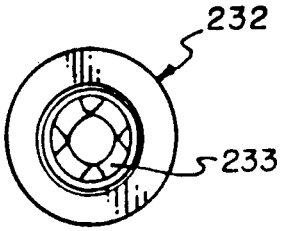

Battery housing base 244 is a single-piece plastic molding and defines, when assembled with contact housing 250 and cover 242, an anchor receptacle 310, into which opens anchor aperture 256, of similar configuration to aperture 56 of the first preferred embodiment. Aperture 256 includes slots 264', 266' and 268', of similar orientation and configuration to boot anchor lugs 264, 266 and 268. Spring alignment struts 316, like struts 116, serve to centrally align wave spring 52 about aperture 256. In lieu of the locking and switching recesses used in the first embodiment, discontinuous arcuate track 450 is utilized for locking and switching of the power pack assembly 238. Gaps 452 in track 450 provide an initial secondary locking position for the power pack assembly, while locking gaps 454 serve the same purpose as locking recesses 122 in the first preferred embodiment, and switching gap 456 performs the same function as switching recess 124. As can be seen in FIG. 19A, track 450 is of reduced height at segments 458 bounding switching gap 456, to give a different feel when the power pack assembly 238 is rotated from a locked position with lug 268 in one of locking gaps 454 into switching gap 456 to turn on heating element 212, than when power pack assembly is being rotated in the opposite direction to remove it from boot anchor 224, thus signalling the boot wearer of the proper direction in which to rotate.

Other than the inclusion of auxiliary or secondary locking gaps 452 to provide additional security for power pack assembly 238 in the event of impact, skier falls, or other shocks and jars, the insertion and rotation of power pack assembly 238 into boot anchor 224 is identical as far as operation of the device is concerned. Water seal 54 and flange 60 or boot anchor 24 have been eliminated in the second preferred embodiment, and in lieu thereof a Lexan or other resilient donut or washer is placed between wave spring 52 and anchor aperture 256, the donut being flexible enough to bend away from lugs 264, 266 and 268 when they enter cavity 310, and to fairly closely engage the outside side of anchor element 262 below the lugs to exclude ice, snow and water from the cavity 310.

It will be appreciated by those of ordinary skill in the art that the present invention comprises a novel and unobvious solution to a long-recognized problem unsolved by the prior art. The present invention provides a universal ski boot heating system adaptable to any boot make, design, or last, and one that does not hinder or impair normal boot function and maintenance. Moreover, the present invention reliably functions in all weather conditions, and is rugged enough to survive the demands placed upon it by the most aggressive skier. Further, the easy replaceability of the present invention's power pack assembly permits the carrying of spare power packs for long days on the slopes, or removing the power packs when skiing and replacing them when waiting for lifts. The present invention also permits ski racers to maintain foot warmth until immediately prior to a race heat, and then remove the power packs to be free of the excess weight during the race.

While the present invention has been described in terms of a preferred embodiment, it is not so limited. Many additions, deletions and modifications may be made to the preferred embodiment without departing from the spirit and scope of the claimed invention. For example, a non-rechargeable power source may be used; the anchor and anchor receptacle locations might be interchanged between the boot assembly and power pack assembly; other designs of resilient contacts are usable; and more.

We claim:

1. A universal heating system for a boot, such as a ski boot, comprising:

a boot assembly securable to said boot including first mechanical connection means, and contact post means electrically connected to a heating element disposable inside said boot; and a power pack assembly including a case containing an electrical energy source electrically connected to contact means, and having second mechanical connection means associated therewith;

said first and second mechanical connection means being adapted for engagement through mutually convergent linear movement followed by mutual rotational movement of less than 360 degrees; and said contact post means being selectively electrically contactable with said contact means after said first and second mechanical connection means are engaged.

2. The apparatus of claim 1, further including biasing means associated with one of said boot assembly or said power pack assembly for opposing said relative mutually convergent linear movement.

3. The apparatus of claim 1, wherein said first mechanical connection means is immovably fixed to said boot assembly, and said second mechanical connection means is immovably fixed to said power pack assembly.

4. The apparatus of claim 1, wherein said contact post means and said contact means are selectively electrically contactable through further mutual rotational movement of said first and second mechanical connection means after said mutual engagement thereof.

5. The apparatus of claim 1, wherein:

one of said first and second mechanical connection means comprises an anchor, and the other of said first and second mechanical connection means comprises an anchor aperture opening into an anchor receptacle adapted to receive at least a portion of said anchor therein.

6. The apparatus of claim 5, wherein one of said anchor and said anchor aperture includes at least one lug thereon, and the other of said anchor and said anchor aperture includes at least one slot therein adapted to mate with said at least one lug to permit said anchor to pass linearly into said anchor receptacle through said anchor opening when said anchor and said anchor opening are disposed at a preselected rotational orientation.

7. The apparatus of claim 6, wherein said at least one lug is disposed on the periphery of said anchor, and said at least one slot is disposed on the periphery of said anchor opening.

8. The apparatus of claim 6, further including a detent on said at least one lug, and at least one locking recess engageable with said lug detent on the interior of said anchor receptacle upon said mutual rotational movement, whereby said anchor and said anchor receptacle are locked together.

9. The apparatus of claim 8, further including at least one switching recess engageable with said detent on the interior of said anchor receptacle after further mutual rotational movement of said anchor and anchor receptacle, whereby said contact means and said contact post means are placed in mutual electrical contact.

10. The apparatus of claim 9, wherein said at least one lug is disposed on the periphery of said anchor, said at least one slot is disposed on the periphery of said anchor opening, and said at least one locking recess and said at least one switching recess are located proximate the periphery of said anchor opening.

11. The apparatus of claim 10, wherein said at least one locking recess and said at least one switching recess are rotationally separated by substantially 90 degrees.

12. The apparatus of claim 11, wherein there are two locking recessed diametrically opposed across said anchor aperture and said at least one switching recess is located substantially 90 degrees from each locking recess.

13. The apparatus of claim 5, further including a track surrounding said anchor aperture, said track including a plurality of gaps to provide, when engaged with said at least one lug, at least one locking position between said anchor and said anchor receptacle whereat said heating element remains inoperative, and at least one switching position therebetween whereat said heating element is provided with power from said electrical energy source.

14. The apparatus of claim 13, wherein the height of said track is less between said at least one locking position and said at least one switching position than between said at least one locking position and an entry position whereat said at least one lug and said at least one slot are rotationally aligned.

15. The apparatus of claim 14, wherein said gap providing said at least one locking position and said gap providing said at least one switching position are rotationally separated by substantially 90 degrees.

16. The apparatus of claim 15, wherein there are two primary locking position gaps diametrically opposed across said anchor aperture and a switching position gap rotationally located substantially 90 degrees from each locking position gap.

17. The apparatus of claim 16, further including secondary locking position gaps in said track rotationally located between said at least one slot and each of said primary locking position gaps.

18. The apparatus of claim 1, further including water seal means disposed on one of said boot assembly and said power pack assembly, said water seal means adapted, upon engagement of said first and second mechanical connection means, to substantially seal the area of contact between said contact means and said contact post means against water intrusion.

19. The apparatus of claim 18, wherein said water seal means comprises a resilient member compressible between said power pack assembly and said boot assembly.

20. The apparatus of claim 18, wherein said water seal means is disposed in the interior of said case, and surrounds a portion of said boot assembly when said first and second mechanical connection means are linearly engaged.

21. The apparatus of claim 1, wherein said heating element further includes a resistance circuit and electrical conductor means leading therefrom to contact pin means frictionally engageable with said contact post means.

22. The apparatus of claim 21, wherein said contact pin means extend through the wall of said ski boot into said contact post means.

23. A universal heating system for footwear, comprising:

a first assembly adapted to be secured to an item of footwear and including a heating element, a first mechanical connection means and a first energy contact means; and a second assembly including an energy source for said heating element, a second mechanical connection means and a second energy contact means;

one said first mechanical connection and said second mechanical connection means being linearly receivable within the other, and engageable therewith upon relative mutual rotation of less than 360 degrees; and said first and second energy contact means being selectively contactable after mutual engagement of said mechanical connection means to supply said heating element with power from said energy source.

24. The apparatus of claim 23, further including biasing means for opposing receipt of said one of said mechanical connection means by the other thereof.

25. The apparatus of claim 23, wherein said first mechanical connection means is immovably secured to said first assembly, and said second mechanical connection means is immovably secured to said second assembly.

26. The apparatus of claim 23, wherein said first and second energy contact means are selectively contactable through further mutual rotation of said mechanical connection means after engagement thereof.

27. The apparatus of claim 23, wherein said heating element comprises an electrical heating element, and said energy source comprises an electrical energy source.

* * * * *